US005523522A

United States Patent [19]

Koseki et al.

[11] Patent Number: 5,523,522

[45] Date of Patent: Jun. 4, 1996

[54] KEYBOARD MUSICAL INSTRUMENT EQUIPPED WITH PEDAL SENSOR FOR DISCRIMINATING HALF PEDAL AT HIGH RESOLUTION

[75] Inventors: Shinya Koseki; Jun Yamamoto, both of Shizuoka-ken, Japan

[73] Assignee: Yamaha Corporation, Japan

[21] Appl. No.: 131,075

[22] Filed: Oct. 1, 1993

[30] Foreign Application Priority Data

Oct. 2, 1992 [JP] Japan ..... 4-265203

[51] Int. Cl.[6] ..... G10F 1/02

[52] U.S. Cl. ..... 84/21; 84/115; 84/462

[58] Field of Search ..... 84/21, 115, 216, 84/225, 462

[56] References Cited

U.S. PATENT DOCUMENTS 4,215,619 8/1980 Budelman et al. ..... 84/115

4,913,026 4/1990 Kaneko et al. ..... 84/21

5,335,574 8/1994 Matsunaga et al. ..... 84/21

FOREIGN PATENT DOCUMENTS 2-275991 1/1990 Japan .

*Primary Examiner*—Patrick J. Stanzione

*Attorney, Agent, or Firm*—Graham & James

[57] ABSTRACT

A player fingers on the keyboard of an automatic player piano and steps on the soft and damper pedals for variety of musical expression in a recording mode, and a controller drives actuators associated with the keys and the pedals as if the player performs, wherein the controller sequentially checks a digital locational signal to see whether or not transit points indicated by the digital locational signal characterize the locus of the plunger and stores digital locational codes indicative of the characterizing transit points only, thereby improving the faithfulness of the performance without sacrifice of the amount of stored data.

7 Claims, 9 Drawing Sheets

KEYBOARD MUSICAL INSTRUMENT EQUIPPED WITH PEDAL SENSOR FOR DISCRIMINATING HALF PEDAL AT HIGH RESOLUTION

FIELD OF THE INVENTION

This invention relates to a keyboard musical instrument and, more particularly, to a keyboard musical instrument equipped with a pedal sensor for discriminating half pedal at high resolution.

DESCRIPTION OF THE RELATED ART

A keyboard musical instrument such as an automatic player piano is equipped with sensors associated with keys and pedals, and a controller encodes information supplied from the sensors for reproducing the music. Namely, while the player is performing a music on the keyboard, the sensors monitors the keys and the pedals manipulated by the player, and produces electric signals indicative of key motions and status of each pedal. The controller extracts pieces of music information for a performance from the electric signals, and encodes the pieces of music information into digital codes. The digital codes are sequentially stored in a floppy disk for a playback in future. While entering the playback, the controller sequentially fetches the digital codes in the floppy disk, and selectively energizes actuators coupled with the keys and the pedals so as to reproduce the music.

The digital code for each pedal is usually indicative of one of two pedal states, i.e., step-on state or released state, and, accordingly, the associated actuator drives the pedal over the stroke or keeps the pedal no-load.

However, a player usually modifies sounds through not only fully stepping on the pedal but also keeping the pedal on the way to the step-on state. When the player keeps the pedal on the way to the step-on state, the pedal state is hereinbelow referred to as "half-pedal" or "half-pedal state".

In order to faithfully reproduce a music, it is necessary to detect the half-pedal state, and a controller is proposed in Japanese Patent Publication of Unexamined Application (Kokai) No. 2-275991 for producing a digital code indicative of the step-on state, the released state and the half-pedal state.

FIG. 1 illustrates the prior art controlling system 1 incorporated in an automatic player piano, and the automatic player piano comprises a damper pedal 2 rockable with respect to a pedal pin 3, a link mechanism 4 connected between the rear end of the damper pedal 2 and a damper assembly 5 and a string 6 struck with a hammer assembly (not shown) for producing a sound.

While the damper pedal 2 is staying in the released state, the link mechanism 4 allows the damper assembly 5 to be held in contact with the string 6, and the string 6 can not vibrate for producing the sound. Though not shown in FIG. 1, the damper assembly 5 is connected with a key, and leaves the string 6 when a player depresses the key. For this reason, the hammer assembly strikes the string 6, and the string 6 vibrates for producing the sound. On the way to return to the rest position, the key allows the damper assembly 5 to contact with the string 6 again as long as the player keeps the damper pedal 2 in the released state, and the vibrations of the string 6 are rapidly terminated. On the other hand, if the player steps on the damper pedal 2, the link mechanism 4 holds the damper assembly 5 off regardless of the key position, and the string 6 continues to vibrate for prolonging the sound.

However, while the player keeps the pedal 2 in the step-on state, the link mechanism 4 lifts the damper assembly 5, and keeps it there regardless of the key. Therefore, the damper pedal 2 allows the string 6 to continuously vibrate, and prolongs the sound.

If the player keeps the damper pedal 2 in the half-pedal state, the damper assembly 5 softly contacts with the string 6 after release of the key, and the half-pedal state prolongs the sound rather than the released state.

The prior art controlling system 1 aims at controlling the damper pedal 2 as if the player manipulates. The controlling system 1 comprises a controller unit 1*a*, a solenoid-operated actuator 1*b* having a plunger inserted in the link mechanism 4, a sensor unit 1*c* for monitoring the motion of the plunger and a floppy disk driver unit 1*d*.

A microprocessor 1*e*, a read-only memory 1*f*, a random access memory 1*g* and an interface unit 1*h* are incorporated in the controller unit 1*a*, and the microprocessor 1*e* is communicable through a bus system 1*i* with the other components 1*f* to 1*h*. The interface unit 1*h* is connected with a pulse width modulator (not shown), the sensor unit 1*c* and the floppy disk driver unit 1*d*, and the microprocessor 1*e* is communicable through the interface unit 1*h* with the floppy disk driver unit 1*d*. The microprocessor further fetches a digital locational signal LS indicative of the position of the plunger with respect to the stationary solenoid case of the actuator 1*b*, and instructs the pulse width modulator to supply a pulse width modulation signal PWM to the solenoid-operated actuator 1*b* for changing the position of the plunger. Namely, the microprocessor supplies a hexadecimal instruction code variable between 00 to 7 F to the pulse width modulator, and the pulse width modulator changes the duty ratio of the pulse width modulation signal PWM. When the pulse width modulator increases the duty ratio, the solenoid-operated actuator enlarges the magnetic force, and the plunger upwardly projects from the solenoid case.

Assuming now that the sensor 1*c* monitors the plunger of the actuator 1*b* for producing a digital locational signal LS, while the hexadecimal instruction code is being increased, the plunger is projecting from the solenoid case, and the digital locational signal LS changes the value along Plots PR. On the other hand, if the hexadecimal instruction code is stepwise decreased, the plunger retracts into the solenoid case, and the digital locational signal LS traces Plots RT. While the hexadecimal instruction code is being increased, the plunger temporally slows down the upward motion, and the increment of the digital locational signal LS becomes substantially zero or a small value in the region HP due to elasticity of the link mechanism 4 and the play between the link members. After the region HP, the plunger restarts the upward motion, and the damper head leaves the strings 6. In other words, the damper head enters a damper-on state corresponding to the step-on state of the damper pedal 2. On the other hand, Plots PR and RT are merged with each other at the hexadecimal instruction code [00], and the damper pedal 2 enters the released state. The half-pedal state is between the released state and the step-on state, and is represented by the region HP. In the half-pedal state, the damper head is softly held in contact with the strings 6. For this reason, while the player keeps the damper pedal 2 in the half-pedal state, the damper head merely returns to the half-pedal position, i.e., softly contact state with the strings 6 after release of the key, and the sound is sustained longer than a sound produced under the released state.

Thus, the half-pedal gives a player a wide variety of musical expression, and the controller 1*a* is expected to faithfully reproduce the performance. Namely, while a player performs a music, the controller 1*a* periodically fetches the digital locational signal LS at intervals of 4 milliseconds, and the 7-bit digital locational signal LS is reformed into a 4-bit digital locational signal through a data compression process.

The data compression is desirable for decreasing the memory. The binary values of the 4-bit digital locational signal are sequentially stored in a floppy disk in the driver unit 1*d* together with digital codes indicative of key motions.

In the playback, the controller unit 1*a* sequentially reads out the digital codes and the 4-bit data from the floppy disk, and instructs a driver unit (not shown) and the pulse width modulator (not show) to drive key actuators (not shown) and the solenoid-operated actuator 1*b* (not shown). For the pulse width modulator, the controller unit 1*a* produces the hexadecimal instruction code from the 4-bit data indicative of the position of the plunger, and the pulse width modulator changes the duty ratio of the pulse width modulation signal PWM in accordance with the hexadecimal instruction code. The solenoid-operated actuator 1*b* projects and retracts the plunger in response to the pulse width modulation signal PWM. If the 4-bit data is indicative of the half-pedal state, the solenoid-operated actuator 1*b* regulates the plunger to an appropriate location corresponding to the damper position in the region HP, and the keys are driven by the key actuators under the half-pedal state. Thus, the prior art controlling system 1 controls the damper head as if the player performs.

However, a problem is encountered in the faithfulness. This is because of the fact that the controller 1*a* stores the locational information of the plunger in the form of 4-bit data. Namely, error is introduced in the locational information through the data compression, and the feedback loop consisting of the sensor 1*c*, the controller unit 1*a*, the pulse width modulator and the solenoid-operated actuator 1*b* can not regulates the plunger to the correct location in the recording mode due to the error introduced in the data compression and in the interpolation from the 16 points to the 128 points.

SUMMARY OF THE INVENTION

It is therefore an important object of the present invention to provide a keyboard musical instrument which controls a pedal mechanism at high resolution without sacrifice of a recording memory.

To accomplish the object, the present invention proposes to ignore pieces of locational data information which do not characterize the motion of a damper mechanism.

In accordance with the present invention, there is provided a keyboard musical instrument having a recording mode and a playback mode, comprising: a) a keyboard for sequentially specifying notes of a scale while a player performs a music in the recording mode; b) a plurality of sound producing means responsive to the keyboard for producing sounds with the notes specified through the keyboard in the recording and playback modes; c) a modifying means associated with the plurality of sound producing means for changing the impression of the sounds in the recording and playback modes; d) a pedal mechanism connected to the modifying means, and manipulated by the player in the recording mode so as to instruct the modifying means to modify the impression; e) an actuator responsive to a driving signal for driving the pedal mechanism to a position represented by the driving signal in the playback mode; f) a sensor monitoring the motion of the pedal mechanism for producing pieces of locational information respectively indicative of transit points of the motion in the recording mode; and g) a controller having g-1) a recording means analyzing the pieces of locational information to see whether or not the transit points characterize the motion of the pedal mechanism in the recording mode, and memorizing pieces of characterizing information indicative of the transit points characterizing the motion in a memory means, and g-2) a playback means sequentially accessing the pieces of characterizing information in the playback mode, and controlling the actuator so as to restore the motion of the pedal mechanism.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
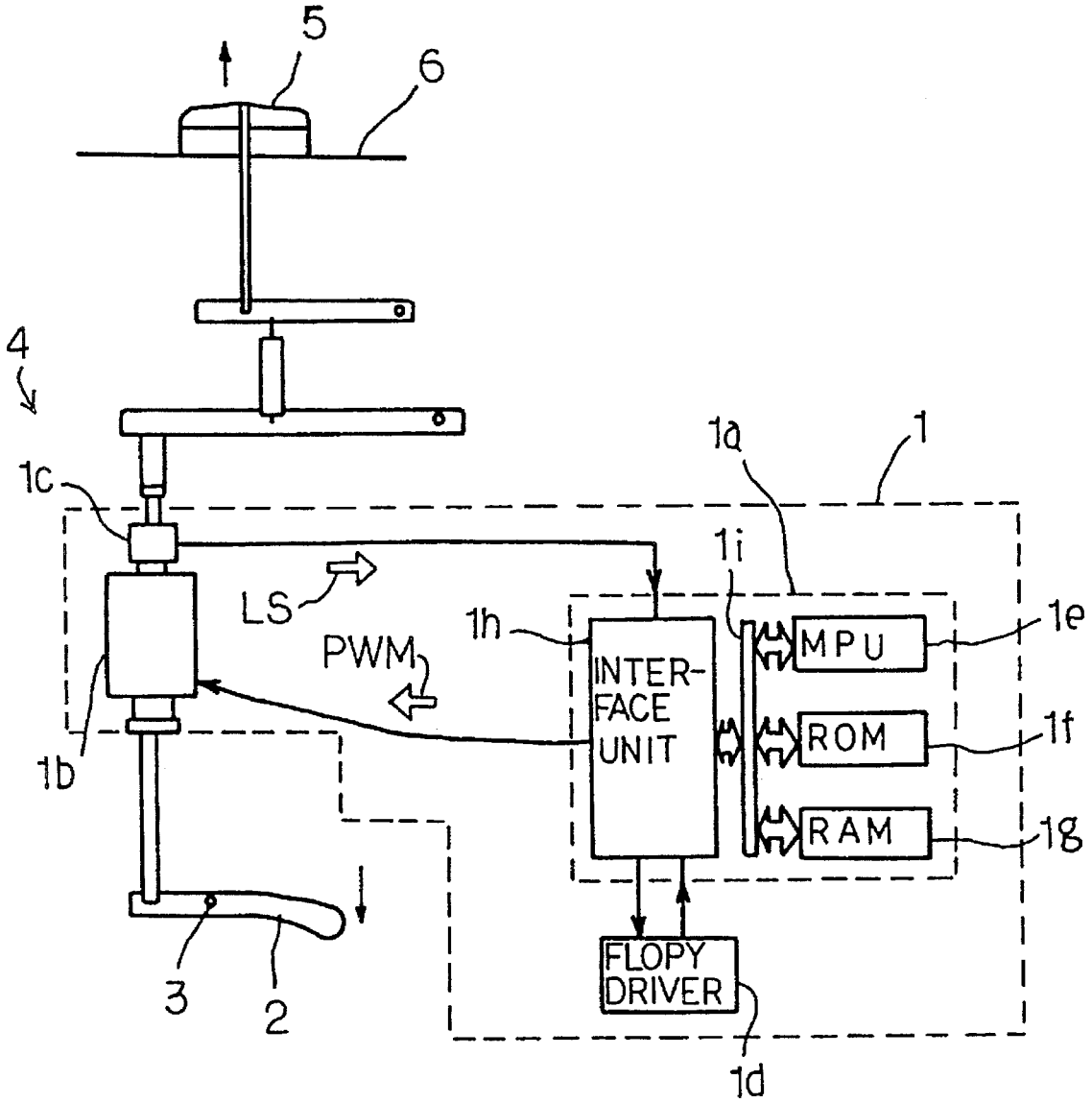
Fig. 1 PRIOR ART
FIG. 1 is a view showing the prior art automatic player piano.
Figure 2:
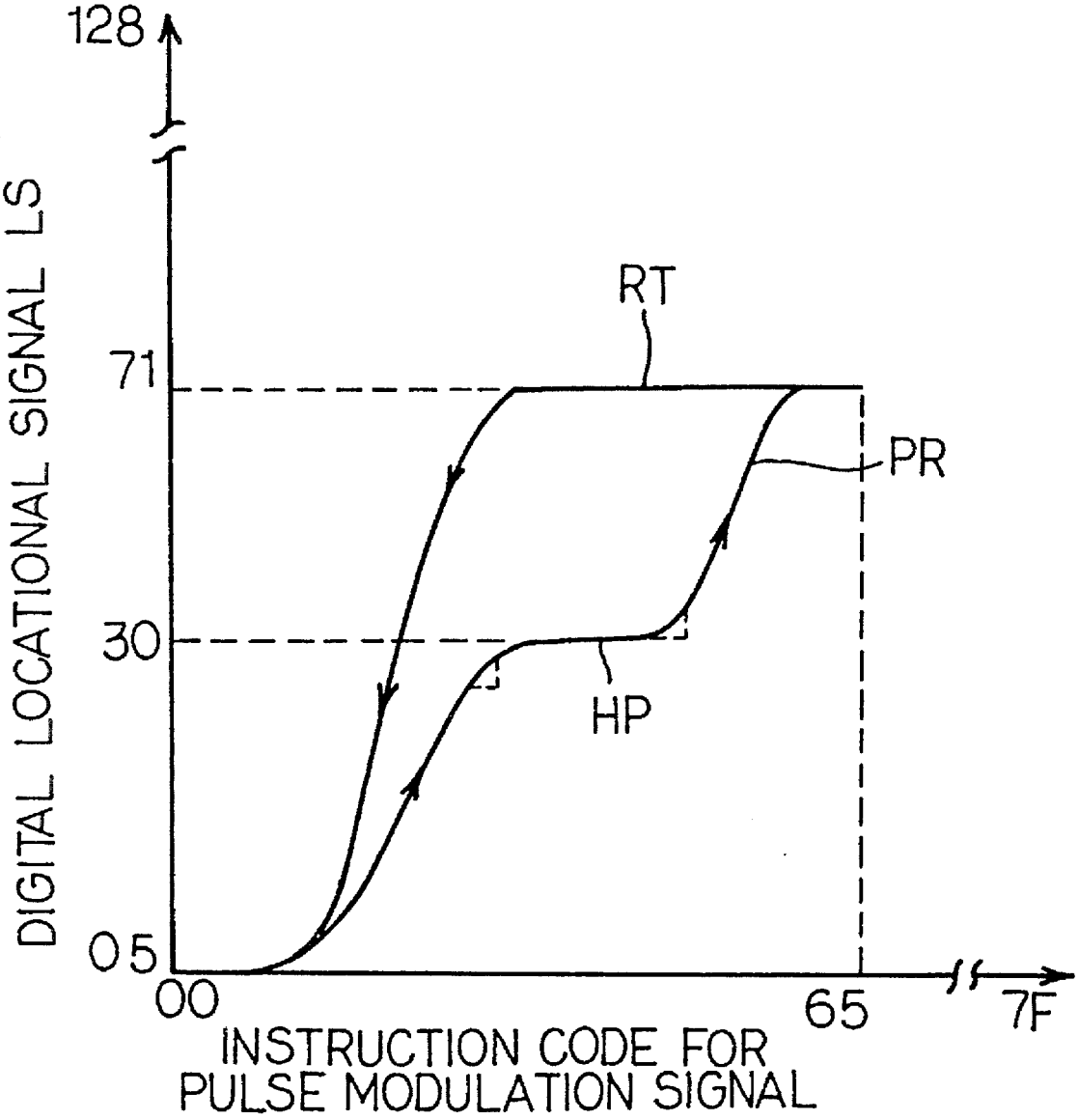
Fig. 2 PRIOR ART
FIG. 2 is a graph showing the relation between the motion of the plunger and the pulse width modulation signal.
Figure 3:
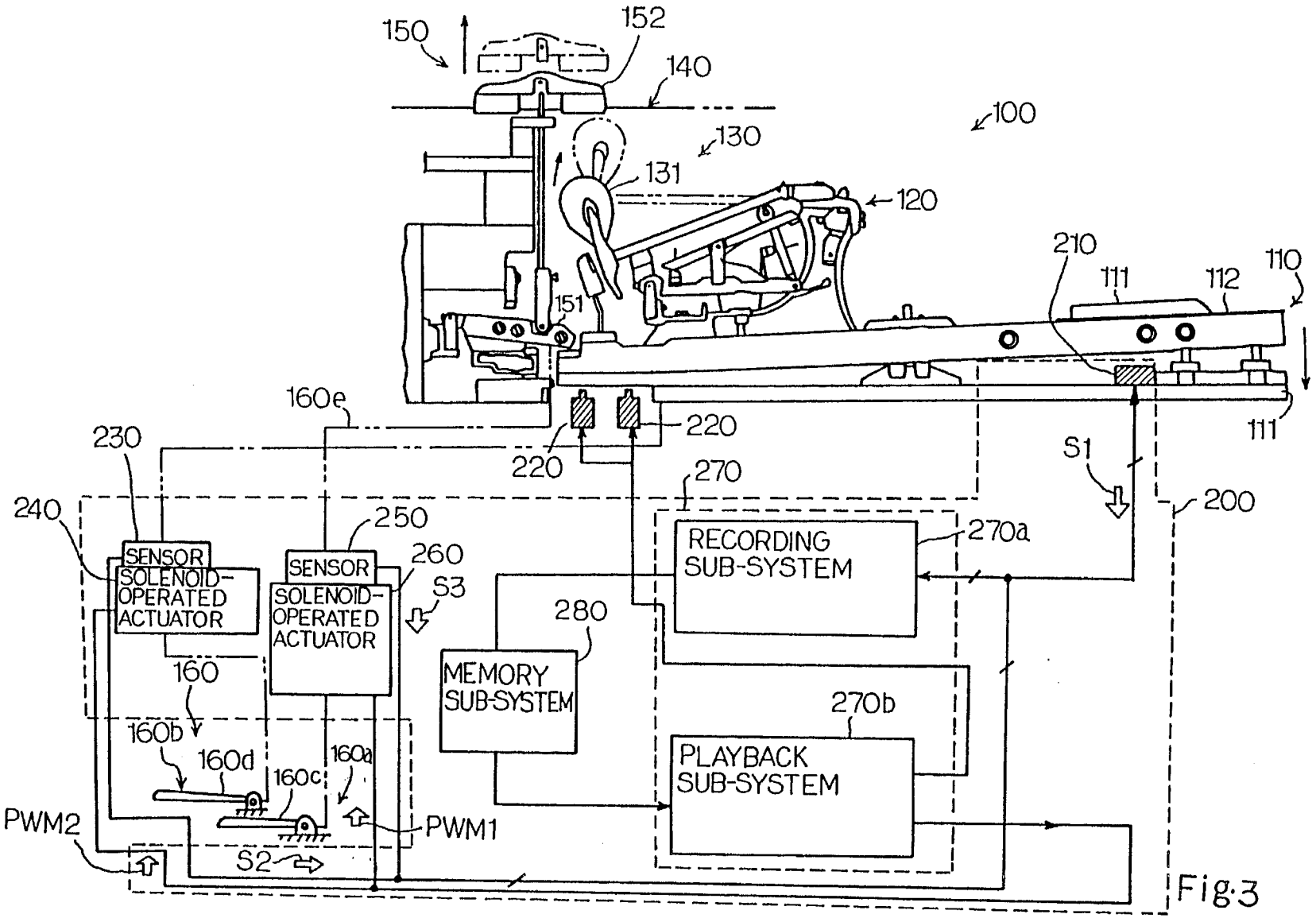
FIG. 3 is a a view showing an automatic player piano according to the present invention.

Referring to FIG. 3 of the drawings, an automatic player piano embodying the present invention largely comprises a mechanical or acoustic piano 100 and an electronic data processing system 200, and selectively enter an acoustic playing mode, a recording mode and a playback mode of operation.

The mechanical piano 100 comprises a keyboard 110 mounted on a key bed 111, a plurality of key action mechanisms 120 associated with the keyboard 110, a plurality of hammer mechanisms 130 respectively associated with the plurality of key action mechanisms 120, a plurality sets of strings 140 respectively struck with the hammer mechanisms 130, a plurality of damper mechanisms 150 respectively associated with the plurality sets of strings 140, and a pedal mechanism 160.

The keyboard 110 has a plurality of black and white keys 111 and 112, and these black and white keys 111 and 112 are respectively linked with the plurality of key action mechanisms 120. Each of the black and white keys 111 and 112 is turnable with respect to a balance key pin when a player depresses the key. The notes of a scale are respectively assigned to the black and white keys 111 and 112 and to the sets of strings 140, and the sets of strings 140 respectively sound the notes of the scale through vibrations at strikes with the hammer assemblies 130. The key action mechanisms 120, the hammer mechanisms 130, the sets of strings 140 and the damper mechanisms 150 are similar to those of a grand piano, and are well known to a person skilled in the art. For this reason, further description on the mechanical structures is not incorporated hereinbelow for the sake of simplicity. In this instance, the key action mechanisms 120, the hammer mechanisms 130, the sets of strings 140 as a whole constitute a plurality of sound producing means, and the damper mechanisms 150 serves as a modifying means.

The pedal mechanism 160 contains a damper pedal sub-mechanism 160*a* and a soft pedal sub-mechanism 160*b*. The damper pedal sub-mechanism 160*a* is connected with the damper levers 151 of the damper assemblies 150 for simultaneously lifting all of the damper levers 151, and the soft pedal sub-mechanism 160*b* is connected with a grand key lever (not shown) for shifting the keyboard 111. The damper pedal sub-mechanism 160*a* causes all of the damper heads 152 to leave the sets of strings, and keeps the damper heads 152 off for prolonging sounds. On the other hand, the soft pedal sub-mechanism 160*b* changes relative relation between the hammer heads 131 and the sets of strings 140, and lessens the volume of the sounds.

While a player is selectively depressing the black and white keys 111 and 112 for a music in the acoustic playing mode, the black and white keys 111 and 112 drive the associated key action mechanisms 120, and the key action mechanisms 120 in turn drive the associated hammer mechanisms 130 so that the hammer heads 131 strike the associated sets of strings 140. The sets of strings 140 thus struck with the hammers vibrate, and produce the sounds. Before striking the sets of strings 140 with the hammer assemblies 130, the black and white keys 111 and 112 push up the associated damper mechanisms 150 on the way to the rest position, and the damper mechanisms 150 leave the associated sets of strings 140 so as to allow the sets of strings 140 to freely vibrate. After the black and white keys 111 and 112 are released, the damper assemblies 150 are brought into contact with the associated sets of strings 140 as long as the damper pedal sub-mechanism 160*a* does not keep the damper assemblies 150 off. Then, the vibrations of the strings 140 and, accordingly, the sounds are rapidly taken up by the damper heads 152.

When the player steps on the damper pedal 160*c* of the damper pedal sub-mechanism 160*a*, the damper levers 151 are pushed up, and the damper heads 152 simultaneously leave the sets of strings 140. In this situation, even though the player release the keys after the strikes with the hammer heads 131, the damper heads 152 keep off, and the sounds are prolonged.

If the player steps on the soft pedal 160*d*, the soft pedal sub-mechanism 160*b* changes the relative relation between the hammer assemblies 130 and the sets of strings 140, and each of the hammer heads 131 strike a fewer number of strings of the associated set, and the volume of the sound is lessened. Thus, the acoustic piano 100 similarly behaves in the acoustic playing mode of operation.

The electronic data processing system 200 comprises an array of key sensors 210 respectively monitoring the keys 111 and 112 of the keyboard 110 and an array of solenoid-operated key actuators 220 for pulling down the keys 111 and 112, and the key sensors 210 and the solenoid-operated key actuators 220 are enabled in the recording and playback modes of operation.

The electronic data processing system 200 further comprises a pedal sensor 230 for monitoring the soft pedal 160*d*, a solenoid-operated pedal actuator 240 for pulling down the soft pedal 160*d*, a pedal sensor 250 monitoring a link mechanism 160*e* connected between the damper pedal 160*c* and the damper levers 151 and a solenoid-operated actuator 260 with a plunger forming a part of the link mechanism 160*e*, and the pedal sensors 230 and 250 and the solenoid-operated pedal actuators 240 and 260 are also enabled in the recording and playback modes of operation.

The electronic data processing system 200 further comprises a controller 270 communicable with the sensors 210, 230 and 250 and the solenoid-operated key actuators 220, 240 and 260, and a memory sub-system 280 accessible by the controller 270. Though not shown in the drawings, a mode selecting switch is provided at an appropriate position on the acoustic piano 100, and a player instructs the controller 270 to enter one of the acoustic playing mode, the recording mode and the playback mode by manipulating the mode selecting switch.

The controller 270 executes a recording sequence and a playback sequence in the recording and playback modes, respectively, and the controller 270 is functionally broken down into a recording sub-system 270*a* and a playback subsystem 270*b*. Namely, the controller 270 is implemented by a computer unit, and at least a microprocessor, a program memory, a working memory an internal bus system, an interface unit, sample-and-hold circuits accompanied with analog-to-digital converters, pulse width modulators and driver circuits are incorporated in the computer unit. The microprocessor is communicable with the program memory, the working memory and the interface unit through the internal bus system, and is further communicable through the interface unit with the analog-to-digital converters, the memory sub-system 280, the pulse-width modulators and the drivers. The sensors 210, 230 and 250 are connected with the sample-and-hold circuits, and the pulse-width modulators and the drivers are connected with the solenoid-operated actuators 240/260 and the key actuators 220.

The program memory stores a set of instruction codes for the recording sequence and another set of instruction codes for the playback sequence, and the microprocessor sequentially fetches the instruction codes for the recording sequence and the playback sequence. The working memory provides a temporary data storage, and the microprocessor stores and fetches the data codes in the working memory in the recording and playback sequences. In this instance, the microprocessor, the set of instruction codes for the recording sequence, the working memory, the internal bus system and the interface unit as a whole constitute the recording sub-system, and the microprocessor, the set of instruction codes for the playback sequence, the working memory, the internal bus system and the interface unit as a whole constitute the playback sub-system.

The key sensors 210 monitor the associated keys 111 and 112, respectively, and produce respective analog electric signals S1 indicative of the motions of the association keys 111 and 112. The analog electric signals S1 are periodically sampled, and respective discrete values are converted into digital key position signals. The microprocessor periodically fetches the digital key position signals in the recording mode, and analyzes to see whether or not the player depresses any one of the keys 111 and 112. Namely, the digital key position signal is variable depending upon the position of the associated key between the rest position and the end position, and, for this reason, the microprocessor can restore the motion of each key on the basis of the variable value of the digital key position signal.

The pedal sensor 230 monitors the soft pedal 160*d*, and produces an analog electric signal S2 indicative of the location of the soft pedal, and the analog electric signal S2 is also periodically sampled and converted into a digital locational signal. The microprocessor periodically fetches the digital locational signal in the recording mode, and decides the pedal state by using the locus of the soft pedal 160*d*.

The sensor 250 monitors the plunger of the solenoid-operated actuator 260, and produces an analog electric signal S3 representative of the location of the plunger and, accordingly, the motion of the damper pedal 160*c*. The value of the analog electric signal S3 is variable depending upon the position between the released position and the step-on position, and is periodically sampled and converted into a digital locational signal. The microprocessor periodically fetches the digital locational signal produced from the analog electric signal S3 in the recording mode, and produces a series of locational data codes from the digital locational signal through a data processing sequence described hereinlater in detail.

The microprocessor instructs the drivers to supply drive pulse signals to the associated key actuators 220 in the playback mode, and the key actuators 220 pulls down the associated keys. The microprocessor further supplies instruction codes to the pulse width modulators in the playback mode, and the pulse width modulators tailor pulse width modulation signal PWM1 and PWM2 for driving the pedal actuators 260 and 240.

The memory sub-system 280 provides a non-volatile data storage, and is implemented by a floppy disk driver unit and floppy disks in this instance. The floppy disk driver writes digital codes representative of a performance in a floppy disk under the control of the microprocessor in the recording mode, and reads out the digital codes therefrom in the playback mode.

The automatic player piano thus arranged behaves in the recording and playback modes as follows. In the recording mode, the player performs a music as similar to the acoustic playing mode, and the microprocessor sequentially fetches the digital key position signals indicative of the positions of the keys and the digital locational signals indicative of the locations of the pedals 160*c* and 160*d*. The microprocessor determines depressed keys and the loci of the depressed keys, and the encodes the loci of the depressed keys into key data codes. Similarly, the microprocessor determines the pedal state for the soft pedal, and encodes the pedal state into a first pedal data code. While the player is performing the music, the key data codes and the first pedal data codes are sequentially produced by the microprocessor, and are stored in the working memory.

Figure 4:
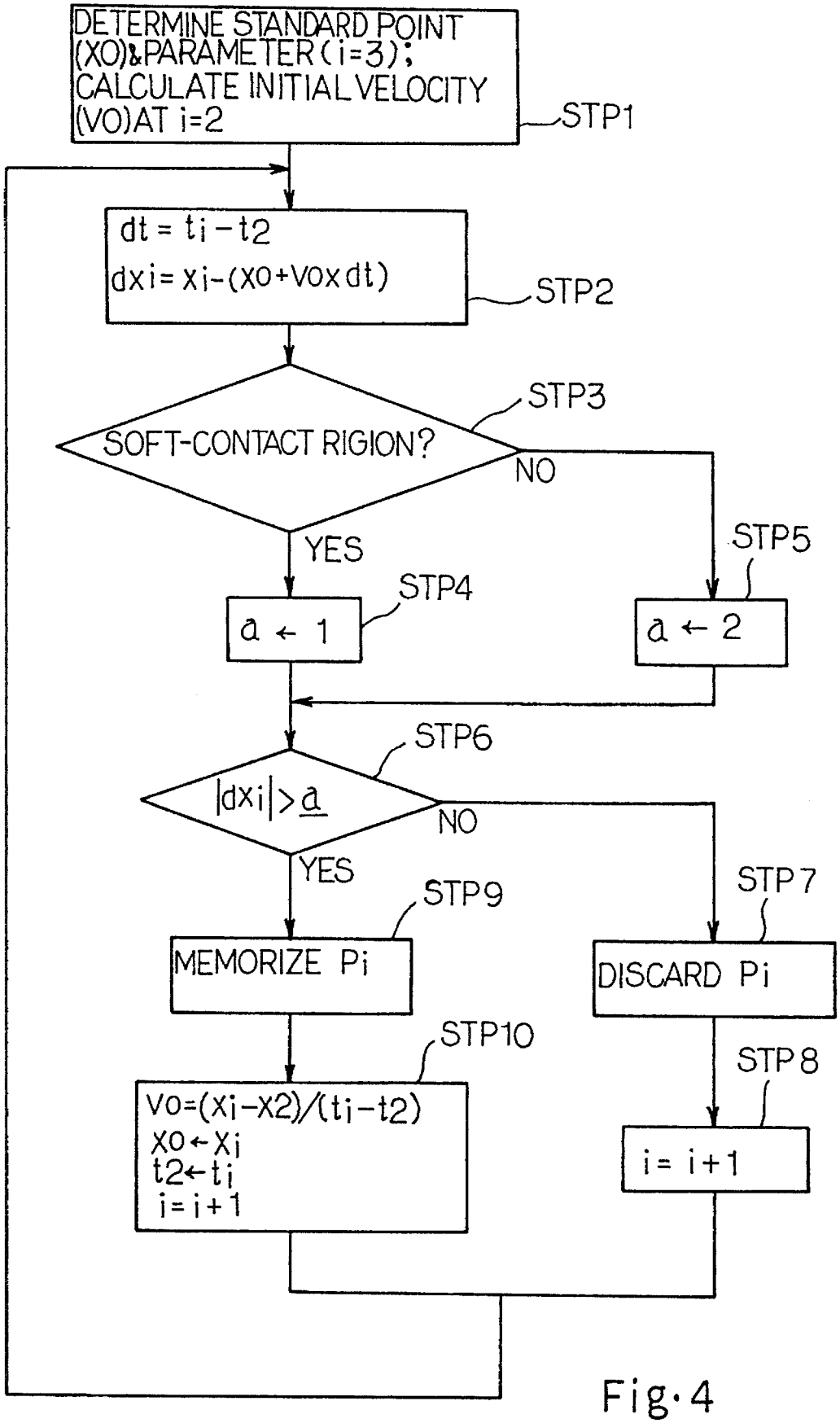
FIG. 4 is a flowchart showing the sequence of a data processing sequence on digital locational signals indicative of a motion of a damper pedal according to the present invention.

As described hereinbefore, the microprocessor periodically fetches the digital locational signal for the damper pedal, and produces a second pedal data code through the data processing sequence described hereinbelow with reference to FIG. 4.

Figure 5:
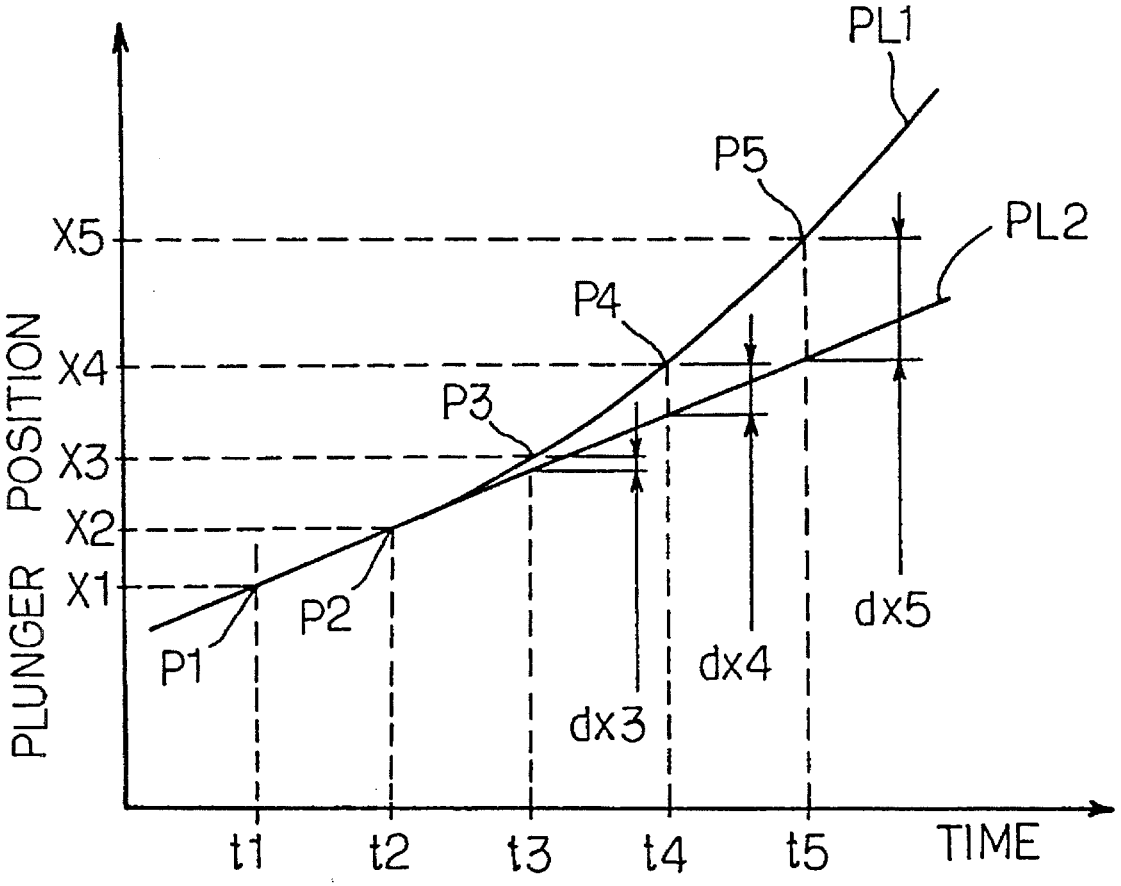
FIG. 5 is a graph showing a locus of a plunger connected with the damper pedal in terms of time.

Assuming now that the plunger forming a part of the link mechanism 160*e* upwardly moves along Plots PL1 of FIG. 5 in the recording mode, P1, P2, P3, P4 and P5 are transit points at times t1, t2, t3, t4 and t5, and X1, X2, X3, X4 and X5 indicate the distances of the transit points P1 to P5 from a dead point of the plunger. In this instance, the analog electric signal S3 is sampled at every 12 milliseconds, and the distances X1 to X5 are indicated by an 8-bit digital locational signal produced from the analog electric signal S3.

First, the microprocessor assumes a standard position X0 of the plunger to be at X2 (see Equation 1), and an initial velocity V0 is calculated by using Equation 2 at step STP1.

$$X0=X2 \qquad \text{Equation 1}$$

$$V0=(X2-V1)/(t2-t1) \qquad \text{Equation 2}$$

The standard position X0 and the initial velocity V0 are available for the data processing after time t3.

Then, the microprocessor proceeds to step STP2, and calculates deviations dxi (where i is equal to or greater than 3) from a predictive values at times t3, t4, t5, . . . The predictive values are plotted on a predictive linear line PL2 in FIG. 5, and the deviations dxi are calculated by using Equation 3.

$$dxi=Xi-(X0-V0\times dt) \qquad \text{Equation 3}$$

where Xi is the plunger position at time t3 or after that and dt is calculated from Equation 4.

$$dt=ti-t2 \qquad \text{Equation 4}$$

where ti is time t3 or after that. The deviations at times t3, t4 and t5 are labeled with dx3, dx4 and dx5 in FIG. 5.

The microprocessor proceeds to step STP3 to see whether or not the current distance Xi indicates that the damper head 152 passes through a soft-contact region where the damper head 152 is held in contact with the strings 140 under a small amount of pressure. Namely, the microprocessor compares the current distance Xi to boundary values $[3C]_{hex}$ and $[50]_{hex}$ to see the current position Xi is not less than $[3C]_{hex}$ and less than $[50]_{hex}$. $[3C]_{hex}$ and $[50]_{hex}$ are hexadecimal numbers. The region between the pedal positions $[3C]_{hex}$ and $[50]_{hex}$ is corresponding to the soft-contact region. If the plunger saturates in the soft-contact region, the player keeps the damper head 152 in the half-pedal state, and the microprocessor is expected to exactly memorize the locus of the plunger. For this reason, the microprocessor analyzes the motion of the plunger as follows.

If the current distance Xi is not less than $[3C]_{hex}$ and less than $[50]_{hex}$, the answer at step STP3 is given affirmative, and the microprocessor proceeds to step STP4. The microprocessor gives "1" to a threshold a. On the other hand, if the current distance Xi is out of the soft-contact region, the answer at step STP3 is given negative, and the microprocessor proceeds to step STP5. At step STP5, the microprocessor sets the threshold a to "2". Thus, the threshold a is different between the soft-contact region and the outside thereof.

After the determination of the threshold a, the microprocessor proceeds to step STP6, and the absolute value of the deviation dXi is compared with the threshold a to see whether or not the current transit point Pi at the distance Xi characterizes the locus of the plunger. If the absolute value of the deviation dXi is greater than the threshold a, the player strongly steps on the damper pedal 160*c* or rapidly releases the damper pedal 160*c*, and the plunger is accelerated or decelerated. Such an accelerating timing or a decelerating timing characterizes the motion of the plunger, and the microprocessor decides that the current transit point Pi should be memorized.

On the other hand, if the deviation dXi is equal to or less than the threshold a, the plunger constantly moves along and/or in the vicinity of the predictive linear line PL2, and the microprocessor assumes the current transit point Pi not to be memorized. If the deviation dx5 is greater than the threshold a and deviations dx3 and dx4 are less than the threshold a, the microprocessor decides to memorize the transit point P5, and discards the transit points P3 and P4.

Namely, when the answer at step STP6 is given negative, the microprocessor discards the transit point Pi as by step STP7, and increments the parameter i as by step STP8. The microprocessor returns to step STP2, and reiterates the loop consisting of steps STP2 to STP8 until the answer at step STP6 is given affirmative. While the microprocessor analyzes the transit points P3 and P4, the answer at step STP6 is negative.

However, when the microprocessor analyzes the transit point P5, the answer at step STP6 is given affirmative, and the microprocessor proceeds to step STP9. At step STP9, the microprocessor produces the locational data code indicative of the transit point Pi (currently P5) for memorizing it in the working memory. The locational data code indicates a pieces of characterizing information.

The microprocessor proceeds to step STP10, and calculates the initial velocity V0 at the memorized transit point Pi (currently P5). Namely, the microprocessor changes the standard point X0 from X2 to X5. Therefore, in the analysis of transit points P6 and after that, the microprocessor calculates the initial velocity V0 at the transit point P5 for transit points P6 and after that as Equation 5.

$$V0=(X5-X2)/(t5-t2) \qquad \text{Equation 5}$$

The deviation dXi is given by Equation 6.

$$dXi=Xi-(X0+V0'\times dt) \qquad \text{Equation 6}$$

where dt is the lapse of time from time t5 to di.

The microprocessor returns to step STP2, and reiterates the loop consisting of steps STP2 to STP10 while the player performs the music. The microprocessor transfers a series of digital locational codes indicative of the characterizing transit points to the floppy disk driver unit at an appropriate timing, and the floppy disk driver unit writes the digital locational codes in a floppy disk. The appropriate timing may take place after completion of the performance.

When the automatic player piano enters the playback mode of operation, the microprocessor serving as a part of the playback sub-system **270*b* instructs the floppy disk driver unit to sequentially read out the digital locational codes together with the key data codes and the locational data codes for the soft pedal 160*d*. The microprocessor sequentially fetches the key codes and the digital locational codes on time basis, and instructs the drivers and the pulse width modulators to selectively drive the keys 111 and 112 and the solenoid-operated pedal actuators 240 and 260**.

If the drivers energize the actuators 220, the associated keys are pulled down, and the key action mechanisms 120 drives the associated hammer mechanisms 130 to strike the sets of strings 140.

While the pulse width modulator energizes the solenoid-operated actuators 240, the relative position between the hammer heads 131 and the strings i40 is shifted, and the strings 140 lessen the volume of the sounds.

One the other hand, when the microprocessor fetches the digital locational code indicative of the characterizing point Pi, the pulse width modulator changes the duty ratio of the pulse width modulation signal, and the solenoid-operated actuator 260 regulates the plunger to the plunger position corresponding to the characterizing point Pi. If the plunger position causes the damper pedal **160*c* to enter the released state, the damper heads 152 are brought into contact with the strings after releases of the keys, and the damper heads 152 rapidly absorb the vibrations on the strings 140. If the plunger position causes the damper pedal 160*c* to enter the step-on state, the damper heads 152 are held off after the releases of the keys, and the sounds are prolonged. On the other hand, if the plunger position causes the damper pedal 160*c* to enter the half-pedal state, the damper heads 152 return to the soft-contact state with the strings 140, and the sounds are slightly prolonged. Thus, the playback sub-system 270*b* exactly controls the solenoid-operated key actuators 220 and the solenoid-operated pedal actuators 240 and 260** as if the player performs, and faithfully reproduces the music.

Figure 6:
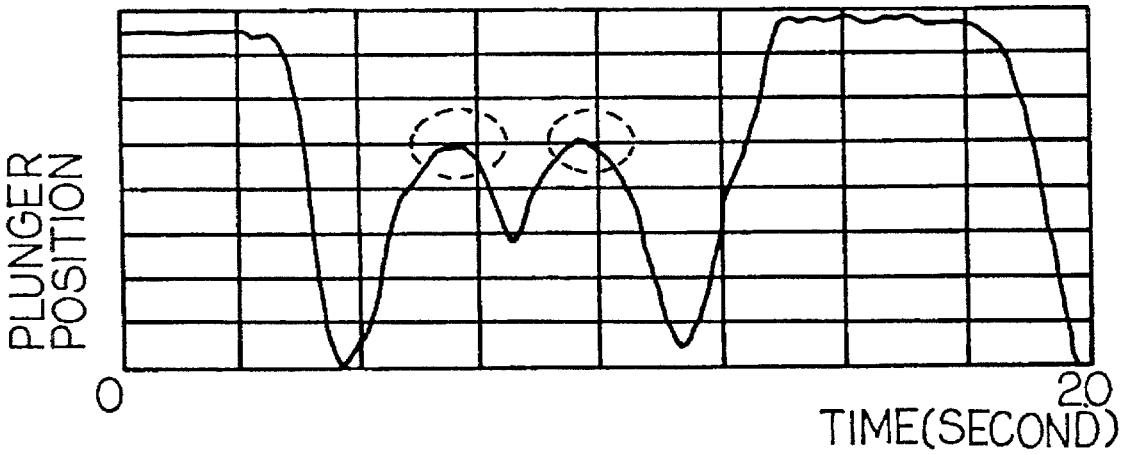
FIG. 6 is a graph showing a locus of a plunger manipulated by a player.
Figure 7:
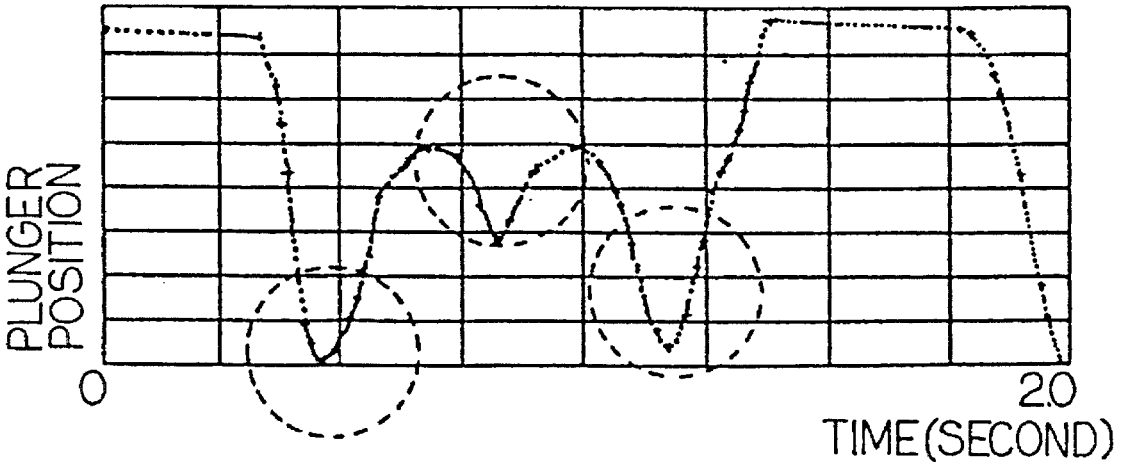
FIG. 7 is a graph showing a locus of the plunger controlled through a controlling sequence according to the present invention.
Figure 8:
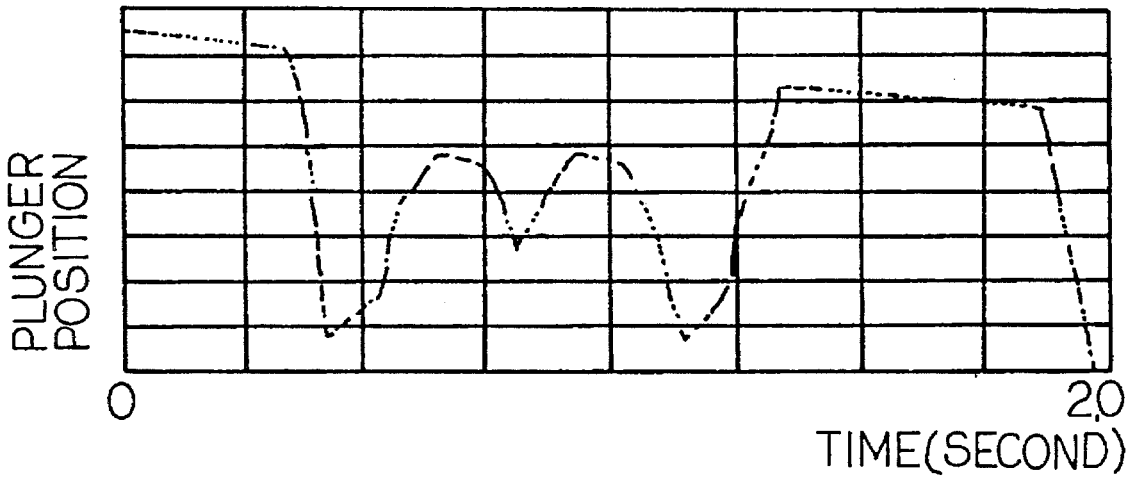
Fig. 8 PRIOR ART
FIG. 8 is a graph showing a locus of the plunger controlled through the prior art controlling sequence.

If the player changes the plunger linked with the damper pedal **160*c* as shown in FIG. 6, the recording subsystem 270*a* picks up 60 characterizing transit points from 166 transit points sampled at 12 milliseconds, and the digital locational codes for the 60 characterizing transit points are stored in the floppy disk. The memory area for storing the digital locational codes is as small as the memory area occupied by the 4-bit data codes of the prior art system. Using the stored digital locational codes, the playback sub-system 270*b* controls the plunger, and the locus of the plunger is shown in FIG. 7. On the other hand, when the plunger is controlled through the prior art controlling sequence by using the 4-bit data codes, the plunger moves as shown in FIG. 8. Comparing the locus shown in FIG. 6 with the loci shown in FIGS. 7 and 8**, it is understood that the digital locational codes for the characterizing transit points Pi effectively reproduces the motion of the plunger.

As will be appreciated from the foregoing description, the recording sub-system analyzes the digital locational signal produced from the analog electric signal S3, and memorizes the characterizing transit points Pi in the locus of the plunger. These characterizing transit points Pi allows the playback sub-system **270*b*** to faithfully restore the motion of the plunger without increase of memory area to be required.

Second Embodiment

Figure 9:
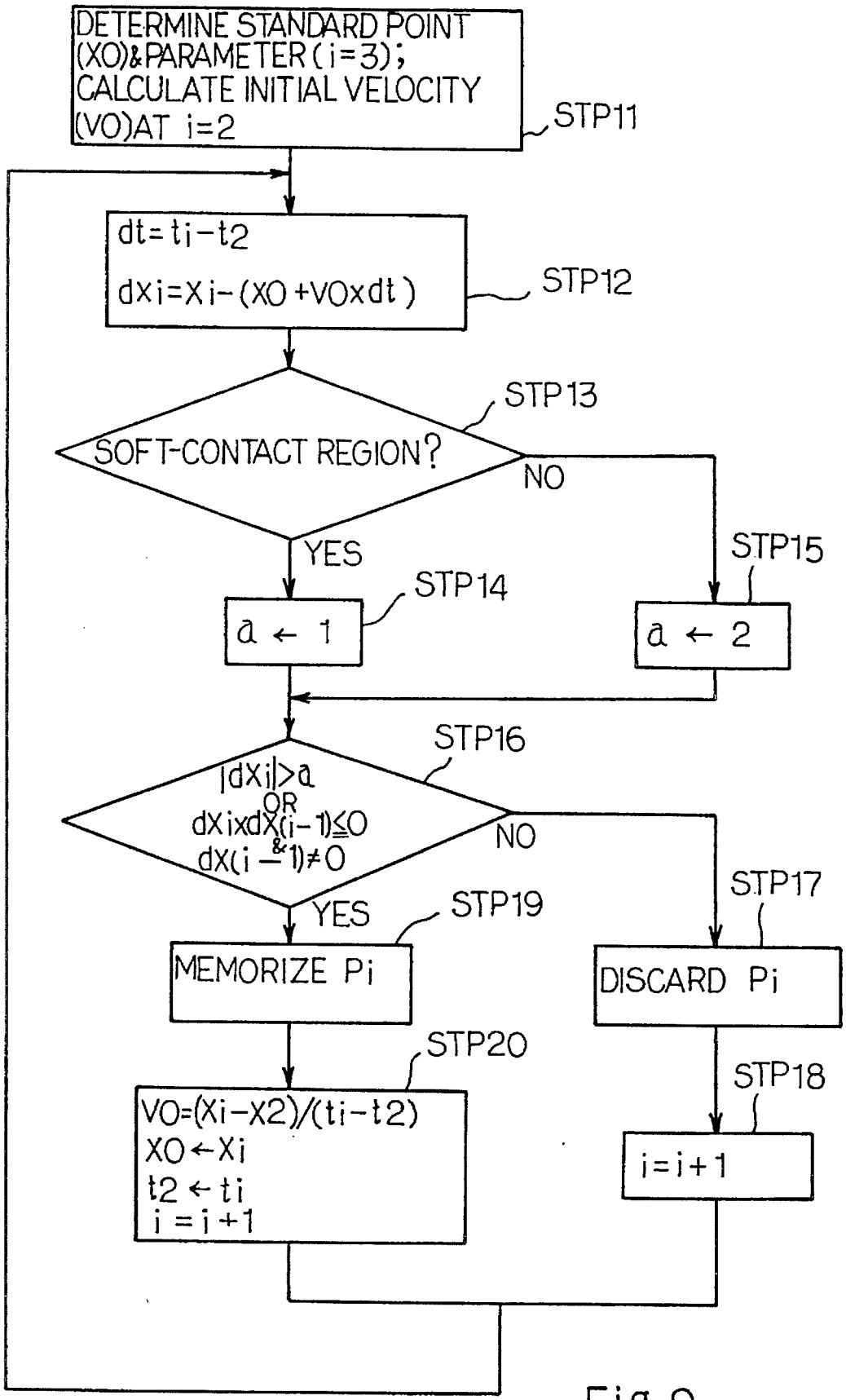
FIG. 9 is a flowchart showing another data processing sequence on digital locational signals indicative of a motion of a damper pedal according to the present invention.

Turning to FIG. 9 of the drawings, another data processing sequence embodying the present invention is executable by the controlling unit 270. Not only the controlling unit 270 but also the acoustic piano 100 and the other components of the electric data processing system 200 form an automatic player piano implementing the second embodiment; however, description is focused on the data processing sequence only avoiding undesirable repetition.

Figure 10:
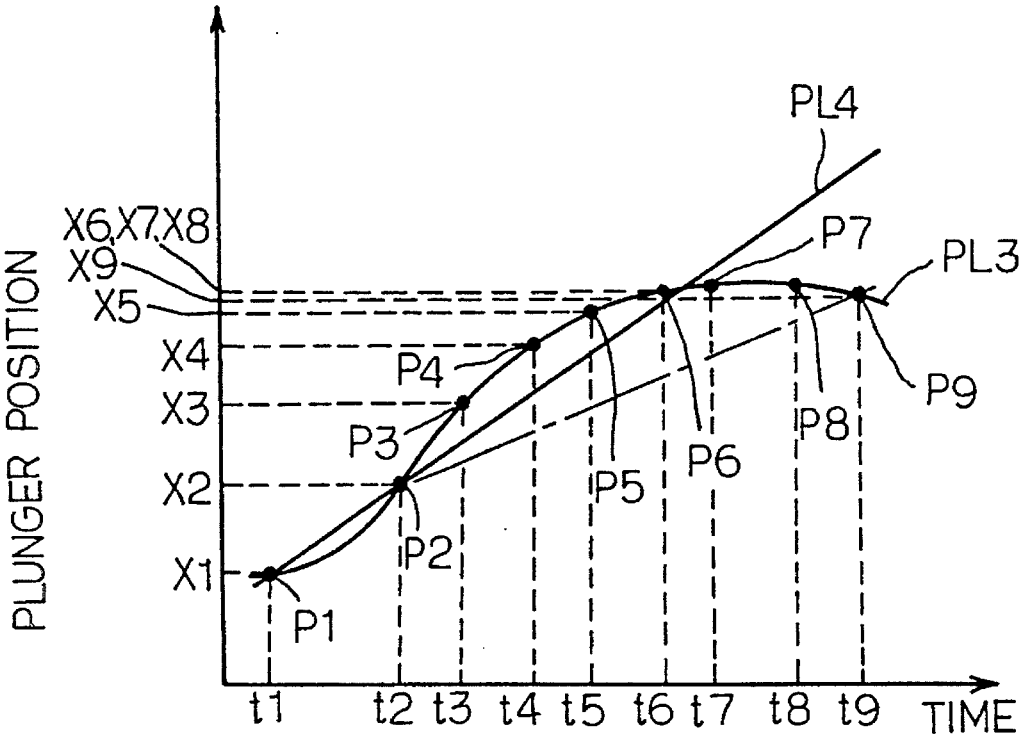
FIG. 10 is a graph showing another locus of a plunger.

The microprocessor executes a program sequence shown in FIG. 9 for selecting characterizing points from transit points of the plunger. Assuming now that the plunger moves along Plots PL3, transit points at time t1 to t9 are labeled with P1 to P9 in FIG. 10, and the distance of the plunger is changed from X1 to X9 at times t1 to t9. In the following description, deviations at the transit points P3 to P9 are assumed to be "+1", "+1", "+1", "0", "0", "−1" and "−2".

The microprocessor decides that the transit point P2 serves as a standard point as by step STP11, and memorizes a piece of characterizing information at the transit point P2. The microprocessor proceeds to step STP12, and calculates the deviation dX3 between the transit point P3 and a predictive line PL4. The predictive line PL4 is calculated by using Equations 3 and 4. The transit points P1 to P9 are assumed to be in the soft-contact region, and the answer at step STP13 is given affirmative. Then, the microprocessor proceeds to step STP14, and sets a threshold a to "1". However, while the microprocessor is checking a transit point out of the soft-contact region, the answer at step STP13 is given negative, and the microprocessor sets the threshold a to "2" as by step STP15.

Subsequently, the microprocessor proceeds to step STP16, and checks the transit point P3 to see whether to be a standard point or not. Namely, the microprocessor compares the absolute value of the deviation at the transit point P3 with the threshold a. The deviation at the transit point P3 is "+1", and the microprocessor decides the transit point P3 not to be memorized as a characterizing point. However, even though the transit point P3 does not indicate the accelerating point or the decelerating point, a point of inflection on the locus characterizes the motion of the pedal, and the microprocessor should memorize it. For this reason, the microprocessor calculates the product of the deviations at the adjacent two transit points Pi and P(i−1) by using the following inequality.

$$dXi \times dX(i-1) \leqq 0 \qquad \text{Inequality 1}$$

where dXi is the transit point presently considered and dX(i−1) is the transit point previously considered. If the product is less than zero, the locus crosses the predictive line PL4, and the transit point Pi is a point of inflection, and serves as a characterizing point. However, if transit points are successively on the predictive line, one of the transit points characterizes the locus, and the other transit points should be discarded because of reduction of the memory area. For this reason, the microprocessor checks the previous transit point whether or not the deviation at the previous transit point is not zero. If the deviation at the previous transit point is zero, the presently considered transit point is discarded for reducing the memory area.

The product for the transit point P3 is a positive value, and the microprocessor proceeds to step STP17. At step STP17, the microprocessor decides the transit point P3 not to be memorized, and increments the parameter i as by step STP18.

The microprocessor returns to step STP12, and repeats steps STP12 to STP16 for the transit point P4. The deviation dXi of the transit point P4 is "+1" and the product is a positive number. Then, the answer at step STP16 is given negative again, and the microprocessor returns through steps STP17 and STP18 to step STP12 again. The transit point P4 does not serve as a characterizing point or a standard point, and is not memorized in the floppy disk.

The microprocessor checks the transit point P5 to see whether to be memorized as a characterizing point or not. Since the transit point P5 has the deviation "+1" and the product is a positive number, the microprocessor reiterates the loop consisting of steps STP12 to STP18, and transit point P5 is also discarded.

Subsequently, the microprocessor checks the transit point P6 to see whether to be a characterizing point or not. As described hereinbefore, the deviation at the transit point P6 is zero, and the absolute value of the deviation is less than the threshold a. However, the product is zero, and the deviation at the transit point P4 is not zero. Therefore, the answer at step STP16 is given affirmative, and the microprocessor proceeds to step 19. At step STP19, the microprocessor decides the transit point P6 to be memorized as a characterizing point, and changes the standard point from P2 to P6 as by step STP20. The predictive line PL4 is unchanged, because the transit point P6 is on the predictive line at the previous predictive line.

The microprocessor returns to step STP12, and repeats steps STP12 to STP16 for the transit point P7. The deviation of the transit point P7 is assumed to be zero as described hereinbefore, and the product is zero again. However, the deviation at the transit point P6 is zero, and the answer at step STP16 is given negative. The microprocessor proceeds to step STP17, and decides the transit point P7 not to be memorized. The microprocessor increments the parameter i at step STP18, and returns to step STP12.

The microprocessor repeats the loop consisting of steps STP12 to STP18 for the transit points P8 and P9. However, both transit points P8 and P9 are not any characterizing point, and are discarded.

Figure 11:
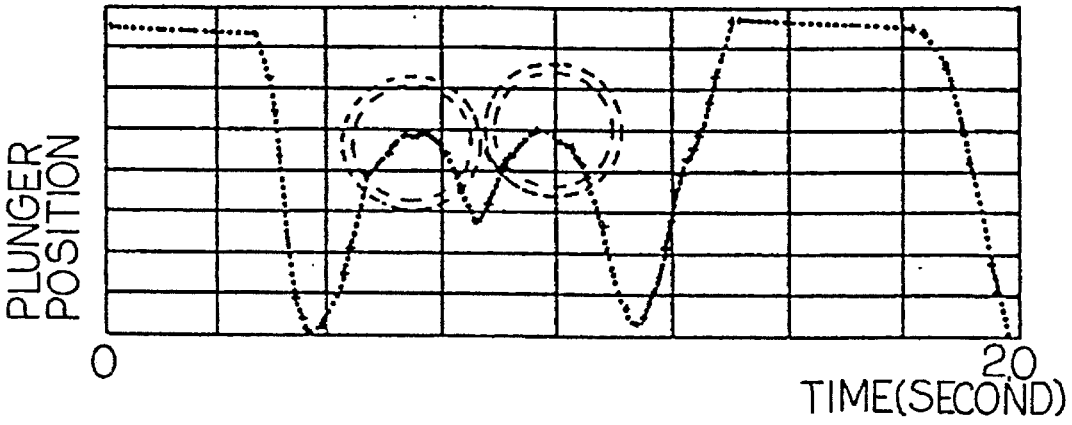
FIG. 11 is a graph showing a locus of the plunger controlled through another controlling sequence according to the present invention.

Thus, the microprocessor executes the data processing sequence shown in FIG. 9, and selects characterizing points, i.e., the accelerating point, the decelerating point and the point of inflection from the transit points Pi until the player completes the performance. the characterizing points are memorized in the floppy disk, and are read out therefrom in the playback mode. FIG. 11 shows the locus of the plunger in the playback mode, and the plunger is controlled in the recording mode under the same conditions as the first embodiment. Comparing FIG. 11 with FIG. 7, the locus in double circles is more faithful than that of the first embodiment, and the characterizing points are 68 selected from 166 transit points. Although the characterizing points are more than the first embodiment, the locus of the plunger is more analogous from the locus shown in FIG. 6.

As will be understood from the foregoing description, the recording sub-system according to the present invention selects the characterizing points from the sampled transit points, and memorizes the pieces of characterizing information at the characterizing points without any data compression. As a result, the resolution is improved without increase of the memory area for storing the pieces of characterizing information, and the playback sub-system faithfully restore the plunger motion.

Although a particular embodiment of the present invention has been shown and described, it will be obvious to those skilled in the art that various changes and modifications may be made without departing from the spirit and scope of the present invention. For example, the present invention is applicable to any interface between a player and a keyboard musical instrument such as a synthesizer as long as the displacement of the pedal is variable depending upon the player's intention. Moreover, the actuator 260 and the sensor 250 may relocate to appropriate positions as long as the damper pedal is exactly monitored and driven.

What is claimed is:

1. A keyboard musical instrument having a recording mode and a playback mode, comprising:

a keyboard for sequentially specifying notes of a scale while a player performs music in said recording mode;

a plurality of sound producing means responsive to said keyboard for producing sounds with the notes specified through said keyboard in said recording and playback modes;

a modifying means associated with said plurality of sound producing means for changing the impression of said sounds in said recording and playback modes;

a pedal mechanism connected to said modifying means, and manipulated by said player in said recording mode so as to instruct said modifying means to modify said impression;

an actuator responsive to a driving signal for driving said pedal mechanism to a position represented by said driving signal in said playback mode;

a sensor monitoring the motion of said pedal mechanism for producing locational data respectively indicative of transit points of said pedal mechanism motion in said recording mode; and a controller having:

a recording means analyzing said locational data to determine whether or not said transit points characterize said motion of said pedal mechanism in said recording mode, and selecting particular transit points characterizing said motion from said transit points, said recording means memorizing characterizing data indicative of said particular transit points in a memory means, and a playback means sequentially accessing said characterizing data in said playback mode, and controlling said actuator so as to restore said motion of said pedal mechanism.

2. A keyboard musical instrument having a recording mode and a playback mode, comprising:

a keyboard for sequentially specifying notes of a scale while a player performs a music in said recording mode;

a plurality of sound producing means responsive to said keyboard for producing sounds with the notes specified through said keyboard in said recording and playback modes;

a modifying means associated with said plurality of sound producing means for changing the impression of said sounds in said recording and playback modes;

a pedal mechanism connected to said modifying means, and manipulated by said player in said recording mode so as to instruct said modifying means to modify said impression;

an actuator responsive to a driving signal for driving said pedal mechanism to a position represented by said driving signal in said playback mode;

a sensor monitoring the motion of said pedal mechanism for producing locational data respectively indicative of transit points of said pedal mechanism motion in said recording mode; and a controller having:

a recording means analyzing said locational data to determine whether the transit points characterize said motion of said pedal mechanism in said recording mode and memorizing characterizing data indicative of the transit points characterizing said motion in a memory means, one of said transit points characterizing said motion of said pedal mechanism if said one of said transit points is sampled at an accelerating timing or a decelerating timing, said one of said transit points sampled at said accelerating timing or said decelerating timing serving as a characterizing transit point, and a playback means sequentially accessing said pieces of characterizing information in said playback mode, and controlling said actuator so as to restore said motion of said pedal mechanism.

3. The keyboard musical instrument as set forth in claim 2, in which said recording means comprises a predictive means calculating a predictive line extending from said characterizing transit point, said predictive line defining a standard region where the transit points except for another characterizing transit point is plotted, a threshold determining means for changing a threshold depending upon the pieces of locational information of another transit point next to said characterizing transit point, a deviation calculating means for calculating a deviation between a position indicated by said piece of locational information for said another transit point and said predictive line, a comparing means operative to compare said deviation with said threshold for checking said another transit point to be whether in said standard region or not, a judging means operative to determine said another transit point to be memorized as said another characterizing transit point if said another transit point is located outside of said standard region, said judging means being further operative to determine said another transit point to be discarded if said another transit point is located in said standard region, and a renewing means operative to replace said characterizing transit point with said another transit point when said another transit point serves as said another characterizing transit point for causing said predictive means, said threshold determining means, said deviation calculating means, said comparing means and said judging means to repeat respective functions.

4. A keyboard musical instrument having a recording mode and a playback mode, comprising:

a keyboard for sequentially specifying notes of a scale while a player performs a music in said recording mode;

a plurality of sound producing means responsive to said keyboard for producing sounds with the notes specified through said keyboard in said recording and playback modes;

a modifying means associated with said plurality of sound producing means for changing the impression of said sounds in said recording and playback modes;

a pedal mechanism connected to said modifying means, and manipulated by said player in said recording mode so as to instruct said modifying means to modify said impression;

an actuator responsive to a driving signal for driving said pedal mechanism to a position represented by said driving signal in said playback mode;

a sensor monitoring the motion of said pedal mechanism for producing locational data respectively indicative of transit points of said pedal mechanism motion in said recording mode; and a controller having:

a recording means analyzing said locational data to determine whether the transit points characterize said motion of said pedal mechanism in said recording mode, and memorizing characterizing data indicative of the transit points characterizing said motion in a memory means, one of said transit points characterizing said motion of said pedal mechanism if said one of said transit points is sampled at an accelerating timing, a decelerating timing or a point of inflection of a locus of said pedal mechanism, said one of said transit points sampled at said accelerating timing, said decelerating timing or said point of inflection serving as a characterizing transit point, and a playback means sequentially accessing said pieces of characterizing information in said playback mode, and controlling said actuator so as to restore said motion of said pedal mechanism.

5. The keyboard musical instrument as set forth in claim 4, in which said recording means comprises a predictive means calculating a predictive line extending from said characterizing transit point, said predictive line defining a standard region where said transit points except for another characterizing transit point is plotted, a threshold determining means for changing a threshold depending upon the pieces of locational information of another transit point next to said characterizing transit point, a deviation calculating means for calculating deviations between a position indicated by said piece of locational information for said another transit point and said predictive line, a comparing means operative to compare said deviation with said threshold for checking said another transit point to be whether in said standard region or not, a first judging means operative to determine said another transit point to be memorized as said another characterizing transit point if said another transit point is located outside of said standard region, a second judging means operative to determines said another transit point in said standard region to be memorized as said another characterizing transit point if a locus between a previous transit point and said another transit point crosses said predictive line, said first and second judging means being further operative to discard said another transit point in said standard region if said locus does not cross said predictive line or said previous transit point is on said predictive line, and a renewing means operative to replace said characterizing transit point with said another transit point when said another transit point serves as said another characterizing transit point for causing said predictive means, said threshold determining means, said deviation calculating means, said comparing means and said first and second judging means to repeat respective functions.

6. A keyboard musical instrument having a recording mode and a playback mode, comprising:

a) a keyboard for sequentially specifying notes of a scale while a player performs a music in said recording mode;

b) a plurality of key action mechanisms responsive to said keyboard for driving associated hammer mechanisms;

c) a plurality of sets of strings associated with said hammer mechanisms, respectively, and respectively struck by the associated hammer mechanisms driven by said plurality of key action mechanisms for producing sounds with the notes specified through said keyboard;

d) a plurality of damper mechanisms associated with said plurality of sets of strings for contacting the associated sets of strings at pressure variable between a released state, a half-pedal state and a step-on state;

e) a pedal mechanism having e-1) a damper pedal manipulated by said player, and selectively entering said released state, said half-pedal state and said step-on state, and e-2) a link mechanism connected between said damper pedal and said plurality of damper mechanisms, and changing said pressure depending upon the state of said damper pedal;

f) an actuator responsive to a driving signal for driving said link mechanism to a position represented by said driving signal in said playback mode;

g) a sensor monitoring the motion of said link mechanism for producing pieces of locational information respectively indicative of transit points of said motion in said recording mode; and h) a controller having h-1) a recording means operative to select characterizing transit points from said transit points for memorizing pieces of characterizing information thereof, said characterizing transit points characterizing said motion of said pedal mechanism, and comprising a predictive means calculating a predictive line extending from one of said characterizing transit points, said predictive line defining a standard region where said transit points except for another characterizing transit point are plotted, a threshold determining means for changing a threshold depending upon the pieces of locational information of another transit point next to said one of said characterizing transit points, a deviation calculating means for calculating a deviation between a position indicated by said piece of locational information for said another transit point and said predictive line, a comparing means operative to compare said deviation with said threshold for checking said another transit point to be whether in said standard region or not, a judging means operative to determine said another transit point to be memorized as said another characterizing transit point if said another transit point is located outside of said standard region, said judging means being further operative to determine said another transit point to be discarded if said another transit point is located in said standard region, and a renewing means operative to replace said one of said characterizing transit points with said another transit point when said another transit point serves as said another characterizing transit point for causing said predictive means, said threshold determining means, said deviation calculating means, said comparing means and said judging means to repeat respective functions, and h-2) a playback means sequentially accessing said pieces of characterizing information in said playback mode, and controlling said actuator so as to restore said motion of said pedal mechanism.

7. A keyboard musical instrument having a recording mode and a playback mode, comprising:

a) a keyboard for sequentially specifying notes of a scale while a player performs a music in said recording mode;

b) a plurality of key action mechanisms responsive to said keyboard for driving associated hammer mechanisms;

c) a plurality of sets of strings associated with said hammer mechanisms, respectively, and respectively struck by the associated hammer mechanisms driven by said plurality of key action mechanisms for producing sounds with the notes specified through said keyboard;

d) a plurality of damper mechanisms associated with said plurality of sets of strings for contacting the associated sets of strings at pressure variable between a released state, a half-pedal state and a step-on state;

e) a pedal mechanism having e-1) a damper pedal manipulated by said player, and selectively entering said released state, said half-pedal state and said step-on state, and e-2) a link mechanism connected between said damper pedal and said plurality of damper mechanisms, and changing said pressure depending upon the state of said damper pedal;

f) an actuator responsive to a driving signal for driving said link mechanism to a position represented by said driving signal in said playback mode;

g) a sensor monitoring the motion of said link mechanism for producing pieces of locational information respectively indicative of transit points of said motion in said recording mode; and h) a controller having h-1) a recording means operative to select characterizing transit points from said transit points for memorizing pieces of characterizing information thereof, said characterizing transit points characterize said motion, and comprising a predictive means calculating a predictive line extending from one of said characterizing transit points, said predictive line defining a standard region where said transit points except for another characterizing transit point are plotted, a threshold determining means for changing a threshold depending upon the pieces of locational information of another transit point next to said one of said characterizing transit points, a deviation calculating means for calculating a deviation between a position indicated by said piece of locational information for said another transit point and said predictive line, a comparing means operative to compare said deviation with said threshold for checking said another transit point to be whether in said standard region or not, a first judging means operative to determine said another transit point to be memorized as said another characterizing transit point if said another transit point is located outside of said standard region, a second judging means operative to determines said another transit point in said standard region to be memorized as said another characterizing transit point if a locus between a previous transit point and said another transit point crosses said predictive line, said first and second judging means being further operative to discard said another transit point in said standard region if said locus does not cross said predictive line or said previous transit point is on said predictive line, and a renewing means operative to replace said one of said characterizing transit points with said another transit point when said another transit point serves as said another characterizing transit point for causing said predictive means, said threshold determining means, said deviation calculating means, said comparing means and said first and second judging means to repeat respective functions, and h-2) a playback means sequentially accessing said pieces of characterizing information in said playback mode, and controlling said actuator so as to restore said motion of said pedal mechanism.

* * * * *